US009897972B2

(12) United States Patent
Heise

(10) Patent No.: US 9,897,972 B2
(45) Date of Patent: Feb. 20, 2018

(54) MECHANICAL CLOCKWORK MOVEMENT WITH AN ADJUSTABLE TOURBILLON

(71) Applicant: Glashuetter Uhrenbetrieb GmbH, Glashuette/Sachsen (DE)

(72) Inventor: Joern Heise, Rudolstadt (DE)

(73) Assignee: Glashütter Uhrenbetrieb GmbH, Glashuette/Sachsen (DE)

( * ) Notice: Subject to any disclaimer, the term of this patent is extended or adjusted under 35 U.S.C. 154(b) by 0 days.

(21) Appl. No.: 15/206,545

(22) Filed: Jul. 11, 2016

(65) Prior Publication Data

US 2017/0060090 A1 Mar. 2, 2017

(30) Foreign Application Priority Data

Aug. 31, 2015 (EP) ..... 15183132

(51) Int. Cl.
*G04B 27/00* (2006.01)
*G04B 17/28* (2006.01)
*G04B 27/02* (2006.01)

(52) U.S. Cl.
CPC ..... *G04B 17/285* (2013.01); *G04B 27/001* (2013.01); *G04B 27/004* (2013.01); *G04B 27/026* (2013.01); *G04B 27/00* (2013.01)

(58) Field of Classification Search
CPC .... G04B 27/00; G04B 27/004; G04B 17/285; G04B 27/001; G04B 27/026
See application file for complete search history.

(56) References Cited

U.S. PATENT DOCUMENTS 6,846,104 B2 * 1/2005 Geyer ..... G04B 27/004 368/127
8,356,929 B2 * 1/2013 Zaugg ..... G04B 19/262 368/127
8,939,639 B2 * 1/2015 Heise ..... G04B 15/14 368/105
2004/0062149 A1 4/2004 Geyer
2010/0103782 A1 * 4/2010 Zaugg ..... G04B 19/262 368/127
2013/0155820 A1 * 6/2013 Rochat ..... G04B 17/28 368/128
2014/0313865 A1 10/2014 Heise

FOREIGN PATENT DOCUMENTS

DE 101 60 287 A1 6/2003
DE 10 2006 008 699 B3 8/2007
EP 2 793 087 A1 10/2014

OTHER PUBLICATIONS

European Search Report dated Mar. 7, 2016 in European Application 15183132, filed on Aug. 31, 2015 ( with English Translation of Categories of Cited Documents and Written Opinion).

* cited by examiner

*Primary Examiner* — Sean Kayes
(74) *Attorney, Agent, or Firm* — Oblon, McClelland, Maier & Neustadt, L.L.P.

(57) ABSTRACT

A clockwork movement with a tourbillon unit, including a base plate, a mobile cage mounted rotatably on the base plate and connected to a second pinion, a balance mounted on the mobile cage and an escape wheel mounted on the mobile cage and being in operative connection with the balance, a balance wheel stop mechanism being capable to be brought into engagement with the balance, wherein it further includes a setting mechanism controlled by an external actuating device for any angular orientation of the mobile cage.

20 Claims, 10 Drawing Sheets

MECHANICAL CLOCKWORK MOVEMENT WITH AN ADJUSTABLE TOURBILLON

This application claims priority from European Patent Application No 15183132.8 filed Aug. 31, 2015, the entire disclosure of which is hereby incorporated herein by reference.

TECHNICAL FIELD

The present invention relates to a mechanical clockwork movement with a tourbillon and also to a mechanical timepiece equipped with such.

BACKGROUND

Tourbillons for mechanical clocks and clockwork movements have been known for some time. In these, the escape wheel, the pallet lever and the so-called balance of the clockwork movement are arranged in a mobile cage which is coupled with or firmly connected to the arbor of the second wheel, consequently the second pinion. The balance or balance staff typically coincides with an imaginary axis extension of the second pinion in this case. A gear wheel connected to the escape wheel finally meshes with a fixed gear wheel disposed coaxial to the balance staff, so that the tourbillon, and therefore its cage performs one complete rotation per minute.

The accurate setting of a mechanical timepiece requires the second display to be stopped. In conventional movements, this is usually achieved by means of a so-called balance stop which for example can be activated by pulling out a crown, and can be deactivated again by pushing in the crown.

In timepieces with a minute tourbillon, in which the second display is achieved directly by the mobile cage of the tourbillon, the realization of such a balance stop turns out to be extremely difficult and complicated.

A balance stop for a tourbillon is well-known, for example from EP 2 793 087 A1. This comprises a braking element which is capable to be brought into contact with the balance and is movable axially to the balance axis. To match the timepiece with a standard time, it is therefore possible to stop the balance and with that the tourbillon mechanism at any time.

SUMMARY OF THE INVENTION

By contrast, the object addressed by the present invention is to provide an improved balance stop for the tourbillon of a mechanical timepiece. In addition for stopping the tourbillon, any angular orientation of the tourbillon is to be realized. This is to give an increased functional scope in that, for example, the position of the mobile cage relative to the gear train and so to the motion-work can be re-coordinated or adjusted at any time.

This object is solved by means of a movement having a tourbillon unit and also a corresponding timepiece having such a movement.

By the invention, it is possible for the first time to move externally regulated an entire tourbillon independent of its escapement part in the clockwork movement. This independent moving allows a tourbillon to be rotated more quickly to a movable point in each of its possible positions. This option can be used to set the time precisely to the second or for other functions, e.g. short time measurements by means of the tourbillon.

Preferably, the present clockwork movement is further provided with a balance stop device that is capable to be brought into engagement with the balance. By means of the balance stop device the balance is at least temporarily fixable relative to the base plate or relative to the cage. Furthermore, the clockwork movement is provided with a disengageable fixing wheel unit that allows the cage to be set to any angular position. According to a preferred embodiment, the disengageable fixing wheel unit is capable to be brought into a non-rotatable engagement either with the cage or the base plate; the disengageable fixing wheel unit is typically rotationally fixed relative to the base plate of the watch/clock when in normal operation.

This means that the disengageable fixing wheel unit is fixed relative to, or directly to, the base plate whereas the cage together with the entire tourbillon unit is subject to a rotational movement relative to the base plate. When the clockwork movement is stopped, the disengageable fixing wheel unit is also, however, detachable from the base plate or can be rotationally decoupled so that it can be rotated relative to the baseplate. Thereby, it typically non-rotatably engages the cage. The disengageable fixing wheel unit is therefore preferably always either rotationally fixed to the cage or rotationally fixed to the base plate or even engages both non-rotatably the cage and the base plate.

To enable the adjustment of the angular position of the cage, it is also necessary to decouple the tourbillon, at least temporarily, from the energy storage device of the clockwork movement. A coupling device for the second pinion preferably exists for this.

According to a preferred embodiment, the present clock movement is coupled to a setting mechanism that is controlled, for example, by a winding crown or setting crown of the movement. By successive or step-by-step pulling out of the crown, three alternative operating modes can be determined in which the winding crown performs a certain function in each case, namely the winding of the main spring, positioning of the hands or the setting of the tourbillon.

According to this preferred embodiment of the claimed clockwork movement where the crown can have three alternative axial positions, the first is in which for example the mainspring can be wound up as usual by the crown, the so-called rest position; the second position at which the balance is stopped, e.g. according to the solution of EP2793087, and so allowing the positioning of the hands; and the third and further pulled axial position where the disengageable fixing wheel unit no longer engages the base plate but only the cage, at the same time the tourbillon is also decoupled from the gear train so that the angular adjustment by rotating the crown is possible.

Preferably, a minute ratcheting can also be present, incl. hands friction in a minute-wheel module similar to that shown in patent EP2224294; however, the tourbillon pinion is preferably made in two parts wherein a first part is coupled to the movement, and the other part is adjustable thanks to a second meshing rotationally fixed to the cage so that the synchronization to the minute display is not lost.

According to a development is intended that the existing control mechanism, that determines the relevant functions of the crown, has a camshaft with three cams arranged on top of each other, that act on three different switching levels and effect the balance stop, the release of the retaining lever for the disengageable fixing wheel unit and the decoupling of the second pinion respectively. The balance stop takes place preferably at the second position of the crown wherein both the release of the retaining lever and the decoupling of the second pinion take place simultaneously when the crown is pulled from the second position to the third position.

According to a further embodiment, the disengageable fixing wheel unit has a support wheel with a rim-type circular band. The circular band is rotatably mounted via its outer circumference on at least three bearing rollers arranged on the base plate. The zero-setting device in particular has a ring-type basic geometry. In a final assembly configuration of the clockwork movement, the hub of the tourbillon unit usually occupies the free center of the ring of the zero-setting device. By means of a mounting via the outer periphery on the support wheel, the disengageable fixing wheel unit can rotatably moved on the base plate also independent of the hub of the tourbillon unit. To make any adjustments to the angular orientation of the tourbillon unit, the disengageable fixing wheel unit further comprises external teeth which mesh with a positioning wheel controlled by the winding crown in the third pulled-out position of the winding crown.

According to a further embodiment, the disengageable fixing wheel unit comprises a ring-type circular wheel with inner teeth which mesh with a pinion of the escape wheel. The circular wheel of the disengageable fixing wheel unit which is also fixed relative to the base plate in the basic configuration or when the clockwork is in motion, meshes with the escape wheel. The escape wheel moves, especially due to the meshing of its pinion with the inner teeth along those inner teeth in the case the tourbillon unit is subjected to a predominant rotary moving when the clockwork movement is in operation. In the basic configuration, the disengageable fixing wheel unit acts in this respect as an extended baseplate along whose inner teeth the escape wheel with its pinion runs.

According to a further embodiment of the clockwork movement, the disengageable fixing wheel unit comprises a stop ring axial movable along its axis of rotation. This has a start slope on a radially outer-lying edge that corresponds to a start slope of a balance stop lever being movable placed on the base plate. Two diametrically opposed balance stop levers are normally provided. These can be provided with a radially inwards direction moving in the direction of the stop ring by pulling out the crown.

The stop ring achieves an axial moving due to the mutually corresponding and matching start slopes of stop ring and balance stop lever, when the balance stop lever is moved radially inwards. By means of the mutually corresponding start slopes of stop ring and balance stop levers, a radial movement can be so translated into an axial movement.

According to a further embodiment, each stop ring movable mounted axially on the disengageable fixing wheel unit comprises a further start slope at a radial inner-lying edge that interacts with at least one cam of at least one latch that is radially inwards movable against a restoring force mounted on the disengageable fixing wheel unit. In this way, by an axial displacement of the stop ring relative to the disengageable fixing wheel unit, in particular relative to the at least one axial adjacent thereto mounted latch, this latch can be radially pivoted.

In particular is provided at least one latch of the zero-setting device can be actuated inwards by means of the at least one balance stop lever induced axial movement of the stop ring. From the mutual engaging of balance stop lever, stop ring and latch of the disengageable fixing wheel unit, it is possible that a pivot movement acting radially from outside on the disengageable fixing wheel unit is converted into a radial inwards pivot movement of the latch provided at the disengageable fixing wheel unit.

According to a further embodiment, the at least one latch comprises a start slope at its inner radial end, that is capable to be brought into engagement with the start slope of a brake ring. The brake ring is typically arranged axially adjacent the latch and is also axially displaceable on a main axis of the tourbillon unit relative to the disengageable fixing wheel unit, for example mounted on the hub of the tourbillon unit. In that the at least one latch and the brake ring engaged with it have start slopes corresponding to each other the typically radial inwards pointing pivoting or adjusting movement of the latch can be translated into an axial directed sliding movement of the brake ring.

According to a further embodiment of this is finally provided a brake bolt that is axially movable guided in a hub of the tourbillon unit or in the cage and is axially displaceable for a displacement of the brake element and for stopping the balance by means of the brake ring. The brake bolt is displaceable especially against a restoring force, especially against the effect of a spring element axial to the brake ring. The brake bolt guides especially the brake element axial movable relative to the balance axis such that it frictionally or frictionally locking engages the balance and finally stops the balance.

At the disengageable fixing wheel unit, usually not only one latch is provided but several, about three, equidistantly spaced to each other, which due to an axial movement of the adjacent placed stop ring perform a synchronous, radially inwards directed movement. Correspondingly, an as uniform and symmetrical as possible displacement force can be exerted on the brake ring which finally leads to an axial advance of the brake bolt.

Independently of the disengageable fixing wheel unit the decoupling of the tourbillon movement can with the help of an inwards regulated pivoting movement of coupling levers similar take place that, for example, are preferably activated by the pulling out of the winding crown from the second to the third axial position, and that effects an axial downward displacement of the second pinion so that this no longer engages a coupling base of the tourbillon pinion. Thus the tourbillon pinion is decoupled from the driving force of the movement. However, as soon as the crown is again slid into the second axial position, the second pinion is again pressed against the coupling base by the restoring force exerted by the coupling spring and the coupling between them is again restored.

According to a further aspect finally a timepiece is provided especially a mechanical wrist watch, that is to be equipped with a previously described clockwork movement.

BRIEF DESCRIPTION OF THE FIGURES

Further aims, features and advantageous embodiments are explained in the following description of an exemplary embodiment with reference to the drawings. The drawings show.

DETAILED DESCRIPTION

Figure 1:
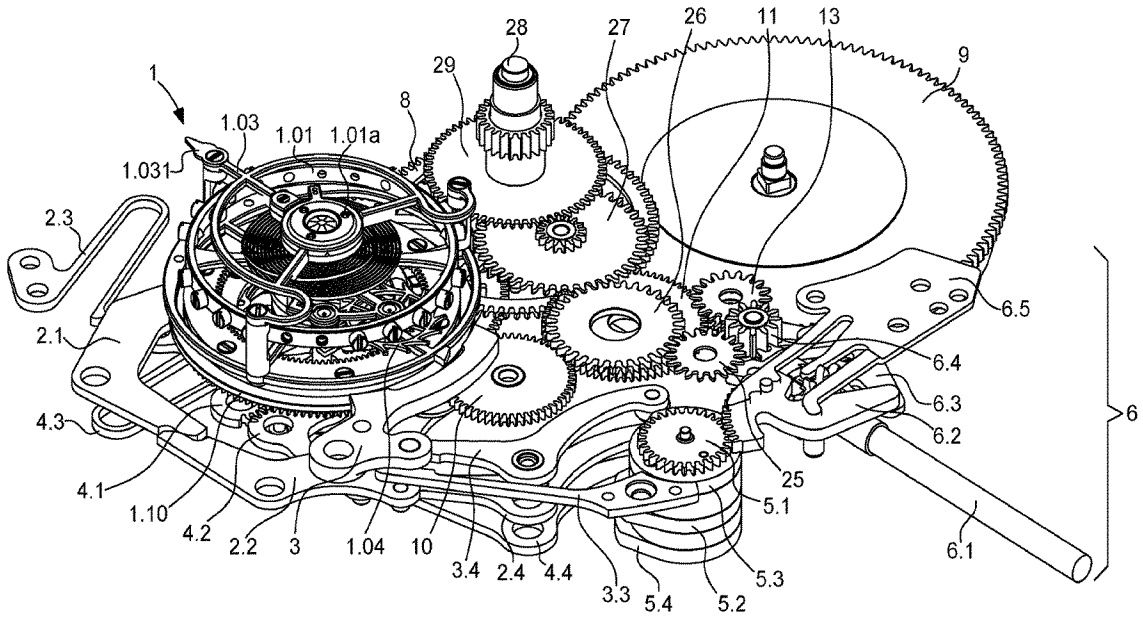
FIG. 1 a top view of parts of the clockwork movement from the dial side

The present clockwork movement comprises as a classical clockwork a tourbillon that further includes a balance stop device (often referred to as "seconds stop") as already described in the invention EP2793087 "Balance stop in a flying tourbillon" of the same patent applicant. The tourbillon unit 1 has the same structure as a conventional tourbillon, i.e. with a mobile cage 1.03 driven by a tourbillon pinion that is also provided with an arrow 1.031 for the second display and in which a balance 1.01 or balance spring 1.01 a and escape wheel 1.04 are arranged. The tourbillon unit 1 is now preferably extended by the addition of a so-called disengageable fixing wheel unit 1.10 and the tourbillon pinion 1.21 has a coupling added to it.

The FIGS. 1 & 2 each show a full view from above and below of the entire clockwork movement, showing both the completed tourbillon unit 1 and the winding and hand-setting mechanisms, and the switch for the second stop and leads further to the setting of the tourbillon. All setting functions are performed here by rotating a winding crown, of which only the winding crown shaft 6.1 is illustrated. The winding crown shaft 6.1 has 3 axial positions each of which defines a particular operating mode which are also explained in detail by the FIGS. 6A/B, 7A/B and 8A/B. A push button could however be provided as an alternative external actuator, especially for the present setting device for the tourbillon unit.

The present clockwork movement has, according to the preferred embodiment shown, a three-stage winding up mechanism as is also usual for watches with rapid date setting using the winding crown. Here, a variant was chosen with a setting lever 6.3 onto which a first setting wheel 6.4 is mounted.

A toothing on the angle lever 6.2 transmits the three possible axial positions of the winding stem 6.1 to a camshaft 5 which comprises a toothed wheel 5.1 which interacts with a toothing of the angle lever 6.2. The camshaft 5 comprises a first cam 5.3 for the balance stop levers (2.1, 2.2), a second cam 5.2 for the retaining lever 3, and a third cam 5.4 for a coupling lever 5.4 and the toothed wheel 5.1 for the camshaft 5. The balance stop levers 2.1 & 2.2, the coupling levers 4.1 and 4.2 and the retaining lever 3 are held against their respective springs (i.e. reference numbers 2.3, 4.3, and 3.3) of the particular function are opened and closed by the relevant cams via respective shift levers 2.4, 3.4, 4.4.

The winding mechanism 6 further comprises, as usual, an additional coupling lever 6.6 for winding the barrel 9, a spring 6.5 for the angle lever 6.2 so that it is always in the same rest position in the basic configuration, i.e. the first axial position of the winding stem 6.1, and besides that a conventional coupling pinion 6.7 and a conventional winding pinion 6.8.

For handsetting in the second axial position of the winding shaft 6.1, a first gear train is provided that meshes with the setting wheel 6.4 that engages the toothing of the coupling pinion 6.7 via a second and a third setting wheel—having the reference numbers 25, 26—and then with the hour-wheel 29 and the minute-wheel 28.

For setting the tourbillon in the second axial position of the winding shaft 6.1, also a second gear train is provided that meshes here also with the first setting wheel 6.4, that engages the toothing of the coupling pinion 6.7 via two superposed tourbillon setting wheels having the reference numbers 12, 13—then with a second tourbillon setting wheel 11 and a first tourbillon setting wheel 10 that finally engage with the external toothing 1.10.1 of the disengageable fixing wheel unit 1.10. Thus a rotational movement of the winding crown in this third axial position is transferable to the disengageable fixing wheel unit 1.10; such a gear train thus provides a preferred embodiment for the claimed setting device according to the present invention. The average skilled person will understand that a different number of tourbillon wheels is possible as well as that the gear ratios between these wheels can be adjusted. It would also be possible to arrange the first tourbillon setting wheel 10 to engage directly with the rotating cage; the preferred variant illustrated provides, however, an aesthetic advantage as the setting device can be completely hidden underneath the rotating cage.

Figure 3:
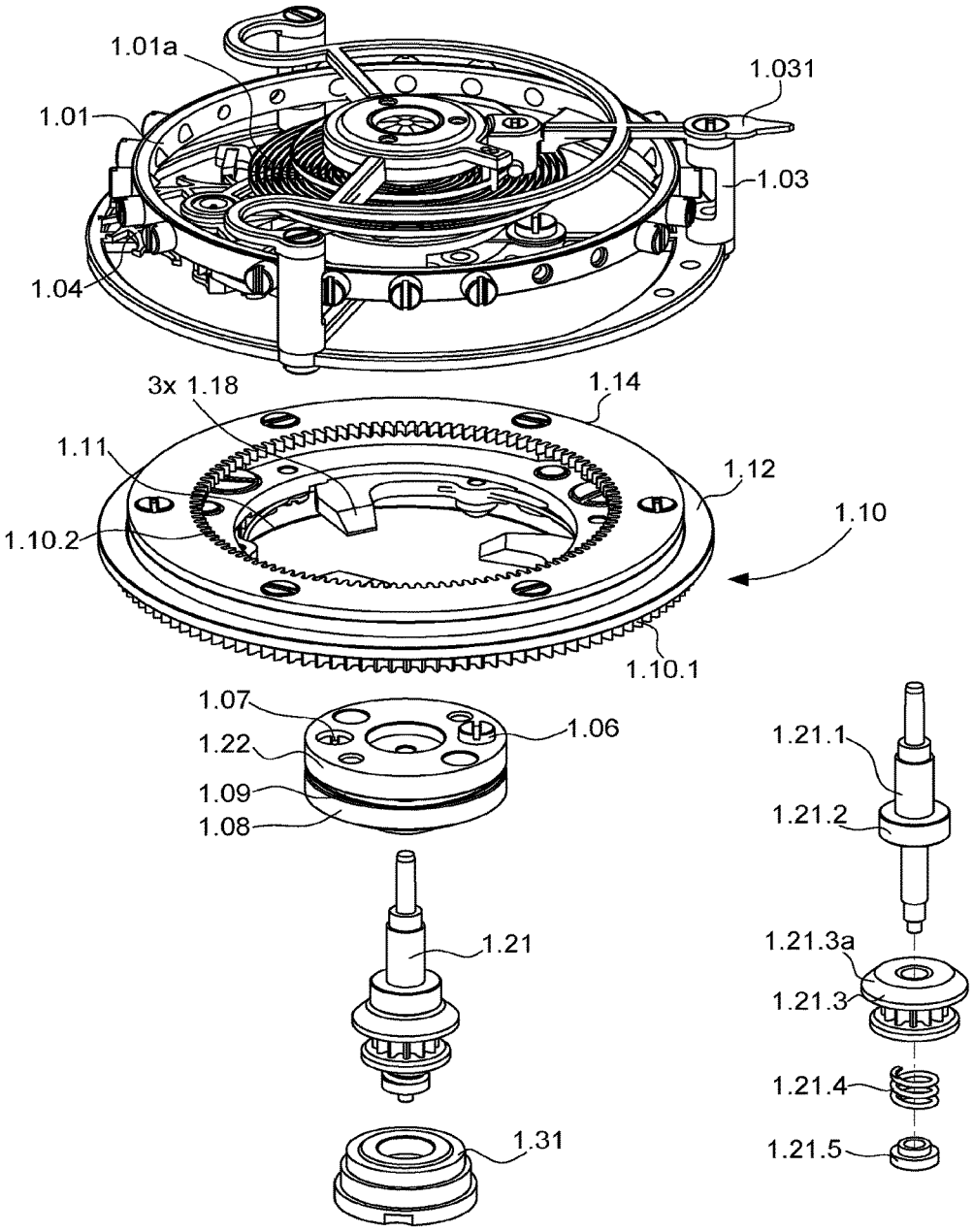

FIG. 3 shows an exploded drawing of the tourbillon unit 1 of the clockwork movement that emphasizes the structure of the disengageable fixing wheel unit 1.10 and of the tourbillon pinion 1.21. The mobile carriage 1.03 of the tourbillon unit 1 driven by the tourbillon pinion 1.21 should mesh via the escapement with the escape wheel 1.04, whose pinion 1.04*a* meshes with the internal toothing 1.10.2 of the disengageable fixing wheel unit 1.10 in order for the circular wheel 1.14 in the disengageable fixing wheel unit 1.10 do carry out one revolution in 60 seconds (one minute), wherein the arrow 1.031 functions as second display. The disengageable fixing wheel unit 1.10 therefore functions as a fixing wheel for the tourbillon unit as long as the retaining lever 3—not shown in this figure—presses on the circumferential band 1.12 of the circular wheel 1.14 and ensures that it therefore remains non-rotatable to the base plate 2.

The latches 1.18, the stop ring 1.11, the two bolts 1.06 and 1.07, the hub 1.22, the expanding spring 1.09 and the ring 1.08 belong to a preferred embodiment of a balance stop device, as published in patent application EP2793087 "Balance stop in a flying tourbillon" and is therefore not described further.

The tourbillon pinion 1.21 is no longer formed as a single piece but comprises several parts to enable the decoupling with the second pinion 1.21.3. The tourbillon pinion is rotatably mounted on a retaining seating 1.31 and rotates about the axis 1.20 of the whole tourbillon unit 1 which also is the axis of the balance 1.01 and of the disengageable fixing wheel unit 1.10. It includes an arbor 1.21.1, a coupling shoulder 1.21.2 and a second pinion 1.21.3, that comprises a start slope to simplify the cooperation with the coupling levers 4.1, 4.2. The second pinion 1.21.3 is displaceable axially along the axis of rotation 1.20 and mounted on a coupling spring 1.21.4 that is supported on a coupling spring support 1.21.5. According to the preferred embodiment shown, a friction coupling is present between the second pinion 1.21.3 and the coupling shoulder 1.21.2; alternatively meshing toothings could be provided for the transfer of the relevant rotational movement between these two parts.

Figure 4:
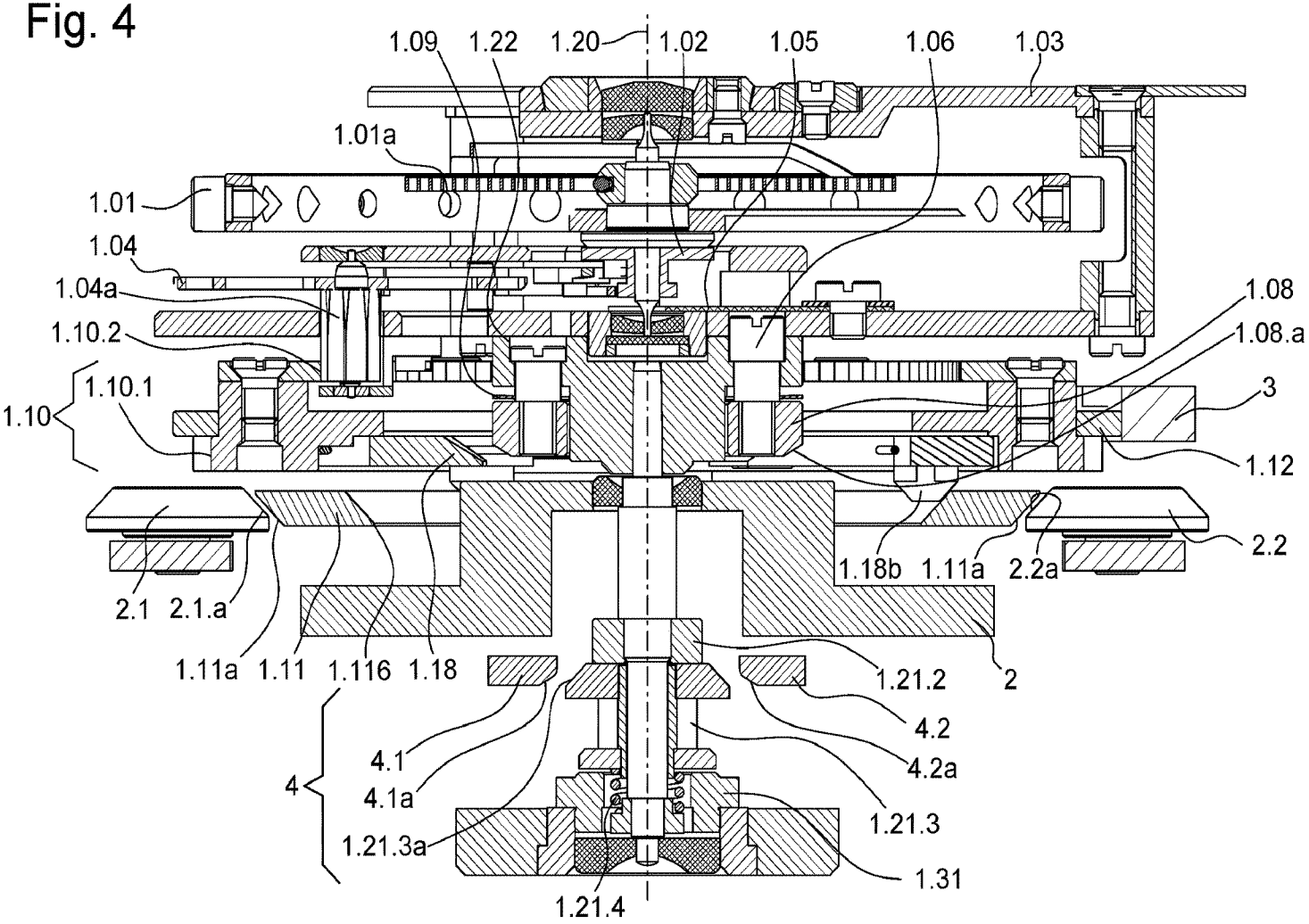

FIG. 4 shows a cross section of the tourbillon unit 1 that comprises a balance stop device as published in the patent application EP2793087 "Balance stop in a flying tourbillon". Such a design is taken as a prerequisite to allow the rotational movement of the mobile carriage 1.03 of the tourbillon unit 1. However, the tourbillon unit 1 is now extended with a disengageable fixing wheel unit 1.10 that interacts with a tourbillon setting wheel 10 and also with a coupling device 4 which should ensure the decoupling of the tourbillon 1.21 from the movement during the setting of the mobile carriage 1.03.

The coupling device 4 contains two coupling levers 4.1 and 4.2, each of which has a start slope 4.1*a* and 4.2*a* which interact with the upper start slope 1.21.3*a* of the second pinion 1.21.3. When pulling out the winding crown from the second to the third axial position, an inwards pivoting movement of the coupling levers 4.1 & 4.2 takes place, which then presses the second pinion 1.21.3 downwards and disconnects the friction coupling with the coupling shoulder 1.21.2, as can be seen later in FIGS. 8A/8B.

Figure 5:
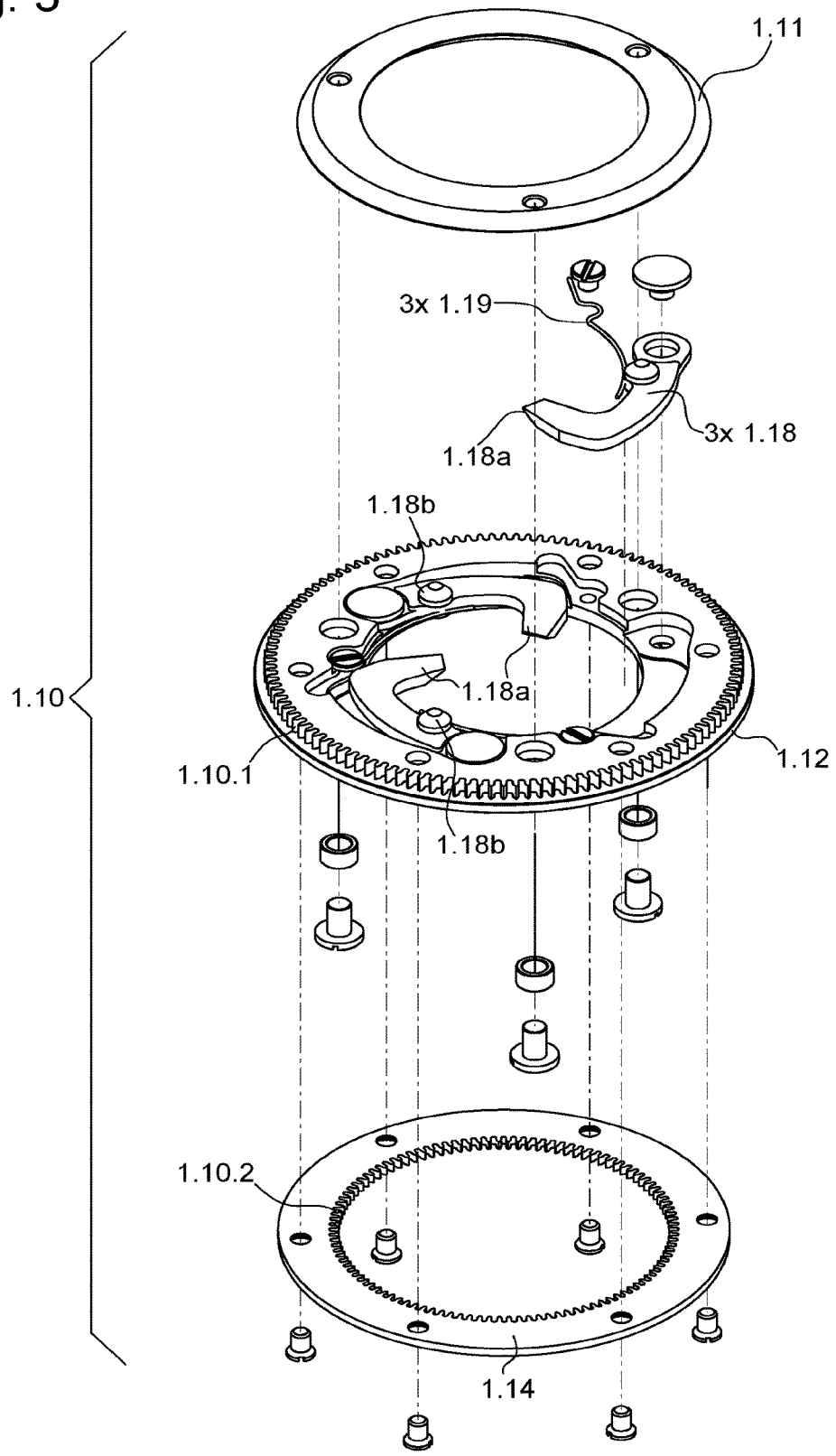

The multi-part assembly of the disengageable fixing wheel unit 1.10 is explained in FIG. 5. The disengageable fixing wheel unit 1.10 comprises a circular wheel 1.14 which includes a central through-passage which is bordered by an inner edge and from which latches 1.18 being distributed arranged protrude inwards in a radial arrangement. These are mounted rotatable or swiveling in the plane of the circular wheel 1.14 and are capable to be moved radially inwards.

Each of the three latches 1.18 shown here comprises a control start slope 1.18*a* at its free and inwards protruding end. A dome-shaped latch cam 47 is respectively formed on the underside of the latches 45. Further, each of the latches 45 is coupled to a latch spring 1.19 by means of which the individual latches 1.18 are displaceable radially inwards against a spring force. The radially inwards directed displacement takes place via an axial force applied to the latch cams 1.18*b*. If the force reduces, the individual latch springs 1.19 effect a movement of the latches 1.18 radially outwards to the start position shown in FIG. 4.

A circumferential band 1.12 is formed at the radial outer edge of the disengageable fixing wheel unit 1.10, as shown in FIG. 5. The disengageable fixing wheel unit 1.10 has with an axial offset to this an external toothing 1.10.1. A circular wheel 1.14 is located on the upper side of the disengageable fixing wheel unit. The circular wheel 1.14 also comprises a ring-shaped contour. On an inner side of the circular wheel 1.14 is formed an annular internal toothing 1.10.2 which, as already mentioned, meshes with the pinion 1.04*a* of the escape wheel.

A stop ring 1.11 is also fixed to the underside of the disengageable fixing wheel unit 1.10. The stop ring 1.11 comprises an external start slope 11.1*a* at its outer edge that can interact with the respective start slopes 2.1*a* and 2.2*a* of the balance stop lever. The stop ring 1.11 can also be axially displaceable and further has, as shown in FIG. 4, an additional inner start slope 11.1*b* that can interact with the latch cams 1.18*b*.

Because of the axial displacement capability of the stop ring 1.11, the inner start slope 1.11*b* of the stop ring 11.*b* can engage with the latch cams 1.18*b* when pulling out the winding crown from its first axial rest position into the second axial position that effects a swivel movement of the two balance stop levers 2.1 and 2.2. An upwards directed axial movement of the stop ring 1.11 thus effects a radial inward displacement of the three latches 1.18, which shifts upwards the brake ring 1.08 and the bolts 1.06 fixed to it and therefore presses the brake spring 1.05 against the double roller 1.02 of the balance 1.01 so that its free end engages frictionally and in axial direction with a therefore appropriately made friction surface of a double roller 1.02, which is connected to the balance 15. In this way, the balance 15 can be stopped and fixed relative to the mobile carriage.

Figures 7A, 7B:
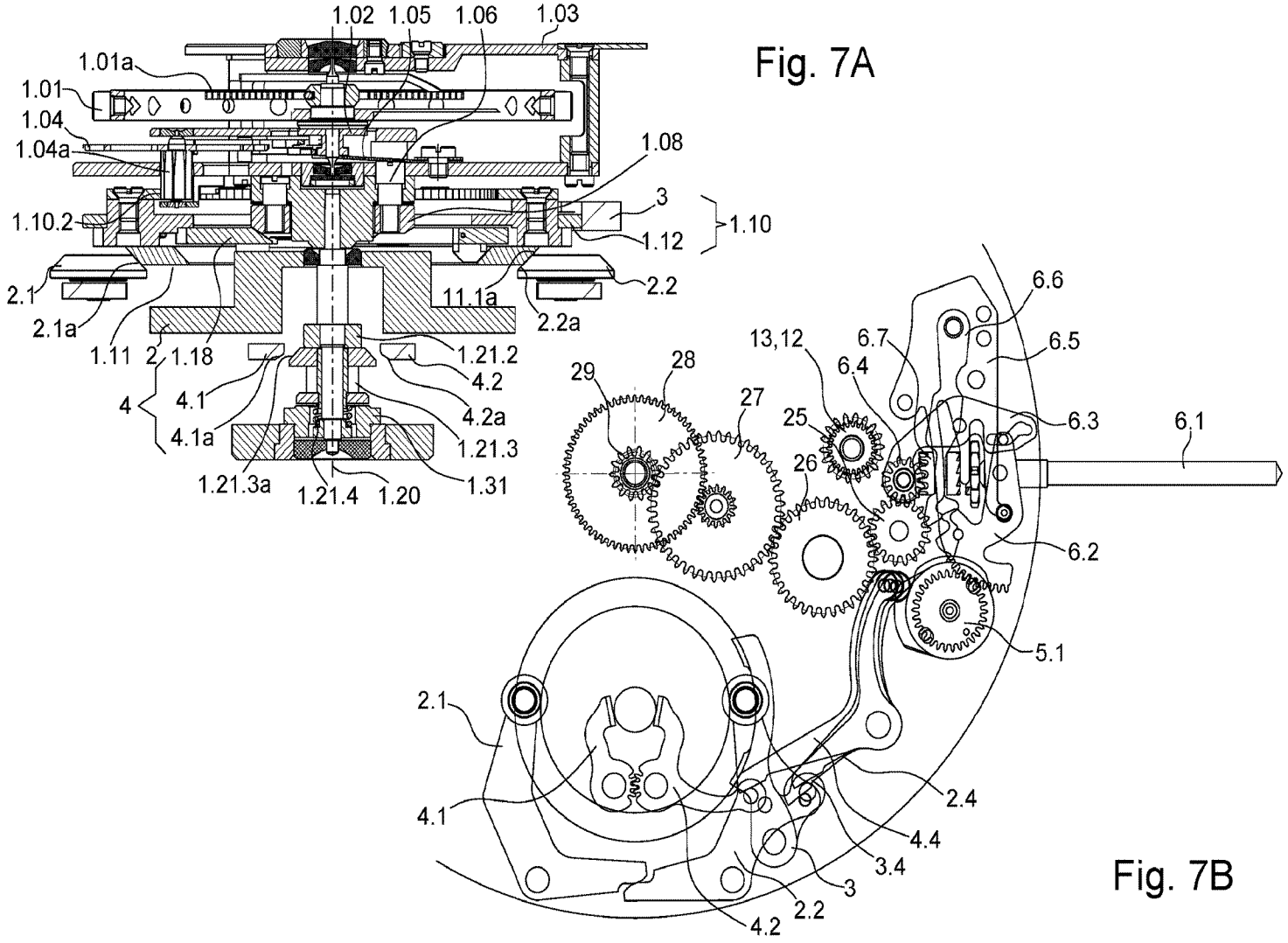

The brake bolt 1.06 can be transferred by means of the axially movable mounted brake ring 1.08 from the starting or base position shown in FIG. 4 to the brake position shown in FIG. 7A/B. Radial external and at the lower end, the brake ring 1.08 comprises a start slope 1.08*a*, which is circumferentially formed and designed to correspond to the control start slope 1.18*a* of the latches 1.18. A radially inwards directed swivel movement of the latches 1.18 therefore leads to an upwards axial shift of the brake ring 1.08 in the direction of the mobile carriage 1.03 by which the brake bolt 1.06 and therefore also the brake spring 60 is axially shifted or axially displaced. Due to the radial inwards swivel movement of the latches 1.18, the brake spring 1.05 finally engages with the double roller 1.02 of the balance 1.01.

The axial displacement of the brake ring 1.08 relative to the hub 1.22 or relative to the mobile carriage 1.03 takes place against the restoring force of a expanding spring 1.09, which is located axially between the hub 1.22 and the brake ring 1.08 (see also FIG. 3). If for example, the latches 1.18 under the influence of their respective latch springs 1.19 are swiveled back into the starting position shown in FIG. 4, a movement of the brake ring 1.08 also takes place under the influence of the expanding spring 1.09 in the same way to its starting position shown in FIG. 4. As a consequence, the balance 1.01 is again released causing the stopped clockwork movement to be automatically set in motion again.

Figure 2:
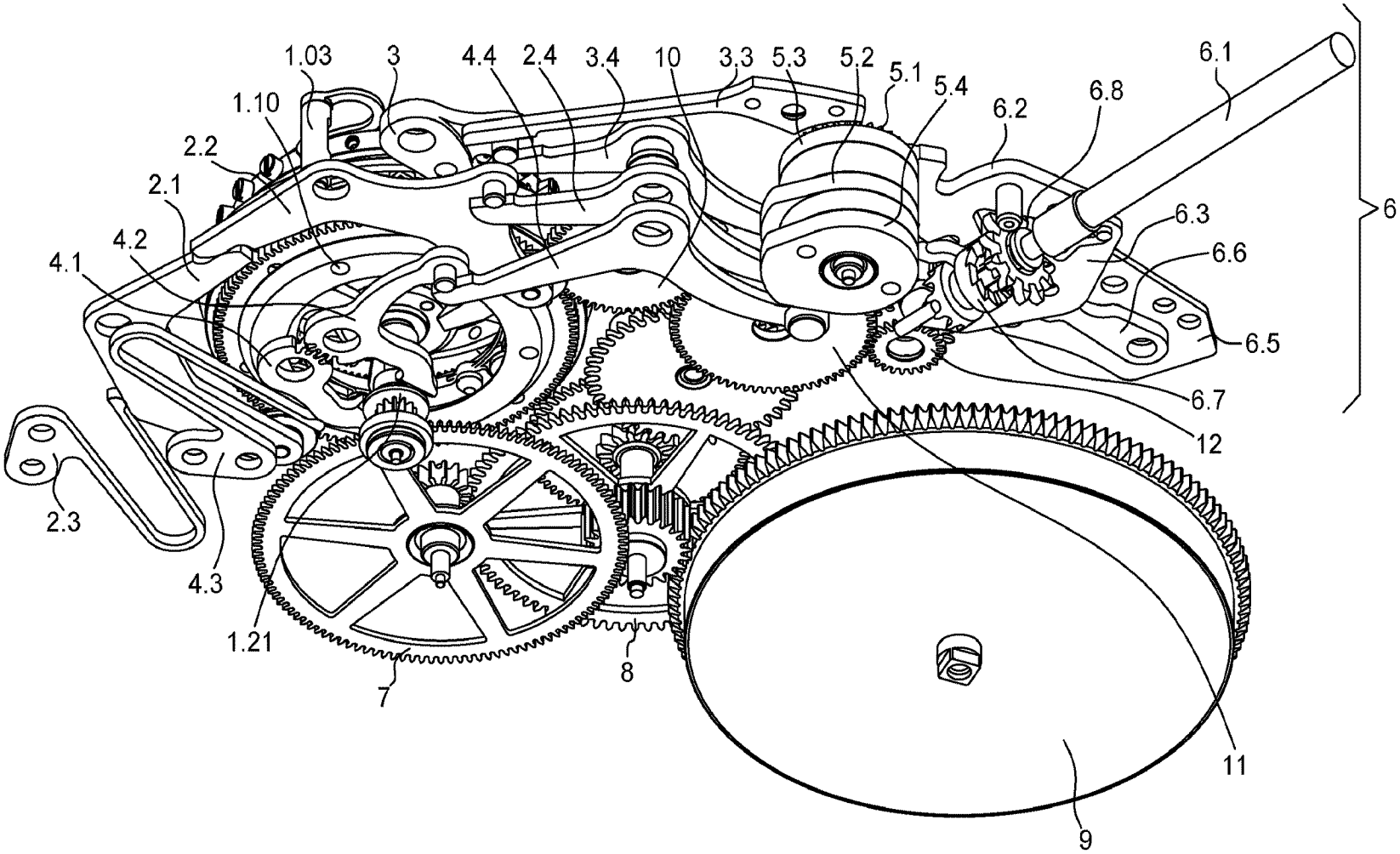
FIG. 2 a top view of parts of the clockwork movement from the bridge side according to FIG. 1, FIG. 3 an exploded view of the tourbillon unit of the clockwork movement with the disengageable fixing wheel unit and the tourbillon pinion, FIG. 4 a cross section of the tourbillon unit according to FIG. 3, FIG. 5 an exploded view of the disengageable fixing wheel unit, FIG. 6A a top view of the control mechanism actuated by the winding crown in its basic configuration (wound-up position) and FIG. 6B a cross section of the tourbillon unit in this basic configuration, FIG. 7A a top view of the control mechanism actuated by the winding crown in its first pulled-out position (setting the hands) and FIG. 7B a cross section of the tourbillon unit in this second operating mode, FIG. 8A a top view of the control mechanism actuated by the winding crown in its second pulled-out position (setting the hands) and FIG. 8B a cross section of the tourbillon unit in this third operating mode, FIG. 9 a view of the tourbillon unit of the clockwork movement with the disengageable fixing wheel unit and of the tourbillon pinion from below wherein the inner pivoting movement of the balance stop lever and the latches, the outer pivoting movement of the retaining lever and the downwards axial movement of the second pinion during the setting procedure of the rotating cage are emphasized, FIG. 10A a cross-section of the clockwork movement between the mainspring barrel and the tourbillon unit in accordance with the preferred embodiment for an adjustable tourbillon with a minutes ratcheting of FIG. 10A FIG. 10B a cross-section of the clockwork between the mainspring barrel and the offset minute wheel in accordance with a preferred embodiment for an adjustable tourbillon that also has a minutes ratcheting.

To stop the clockwork movement and the tourbillon unit 1, two opposed, respective first and second, balance stop levers, 2.1 and 2.2 are provided on the outer circumference of the disengageable fixing wheel unit 1.10 which can be seen in FIGS. 1, 2 and 4. The first balance stop lever and the second balance stop lever 2.2 are swiveling mounted on the base plate 2. A first start slope 2.1*a* and a second start slope 2.2*a* are provided at their free ends. These are in the form of beveled pinions, for example. The respective first and second start slopes 2.1*a* & 2.2*a* of the respective first and second balance stop levers 2.1 and 2.2 are located at the height of the outer start slope 11.1*a* provided at the outer edge of the stop ring 1.11.

A radial inwards directed swiveling of the first and second balance stop levers 2.1, 2.2 leads to a uniform raising or axial displacement of the stop ring 11.1 from the starting position shown in FIG. 4 or base configuration shown into the stop configuration shown in FIG. 7A/B. The axial moving of the stop ring 1.11 leads, as already described, to a radially inwards directed displacement of the latches 1.18 and therefore to an axial shift of the braking bolt 1.06 and finally to a displacement of the braking spring 1.05 that stops the balance 1.01.

Figures 8A, 8B:
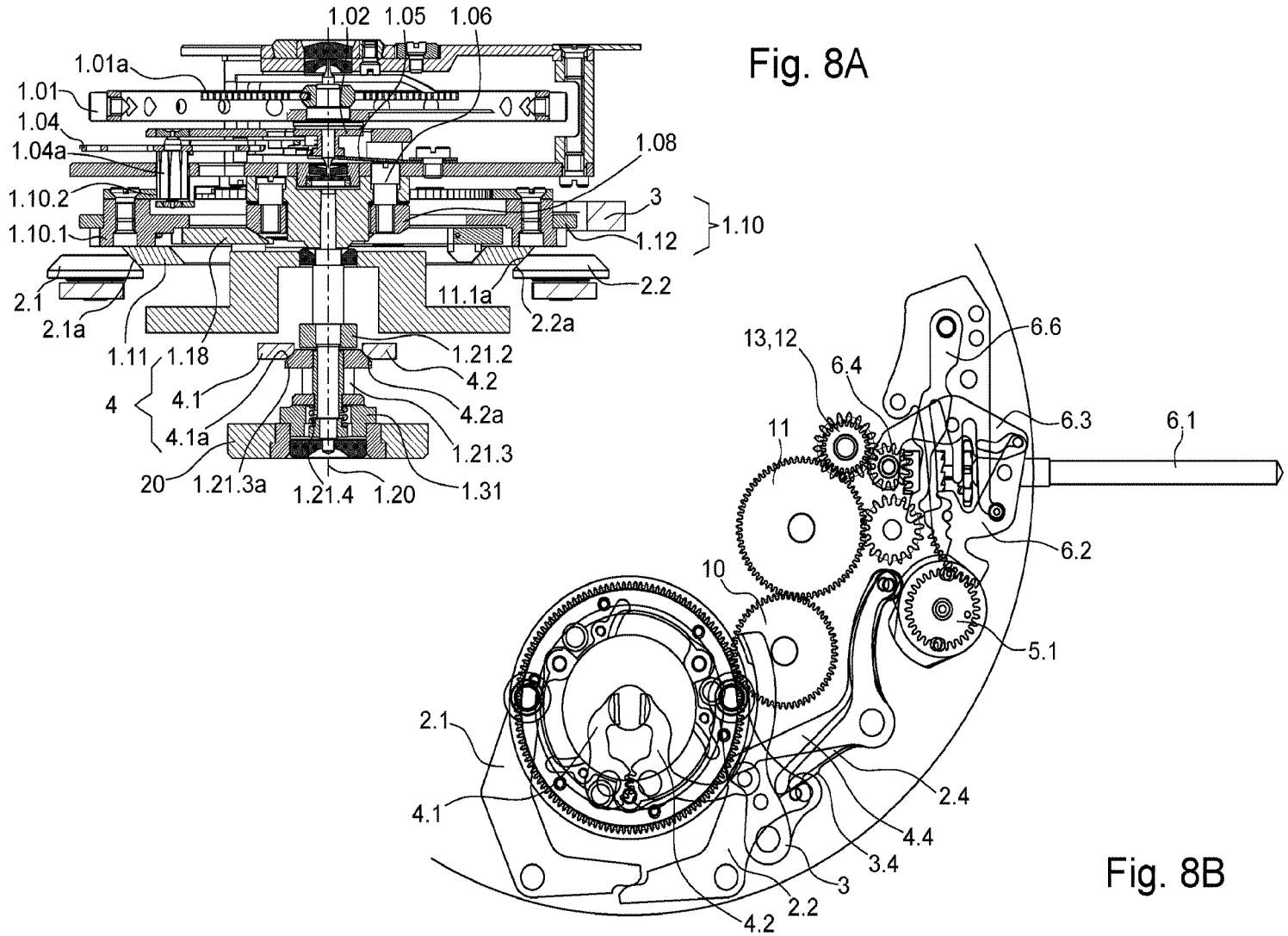

The one synchronous swivel movement of both first and second balance stop levers 2.1, 2.2 that causes a stopping of the clockwork mechanism 1 can take place by pulling out the crown to a given ratchet position. This stops the clockwork movement. If the present winding crown, not explicitly shown, is pulled out starting from that stop configuration to a further, for example second ratchet position, this causes a coupled swiveling of the retaining lever 3, as shown in FIGS. 8A/B.

The disengageable fixing wheel unit 1.10 is detachable fixed to the base plate 2 using a fixing element that is made here as retaining lever 3. A free end of the retaining lever 3 engages, for example frictionally, with an outer edge of the disengageable fixing wheel unit 1.10, e.g. on the circumferential band 1.12.

By a swivel moving of the retaining lever 3 the disengageable fixing wheel unit 1.10 can be released so that it can be rotated relative to base plate 2 about the central axis of rotation 1.20. The axis of rotation 1.20 of the disengageable fixing wheel unit 1.10 can preferably coincide with the balance axis and also with the axis of the second pinion 1.21.3 (and generally also of the tourbillon pinion 1.21).

For the setting of the tourbillon via the zero setting unit 1.10, a mechanism with retaining and coupling levers is therefore needed in accordance with the preferred embodiment of the present invention. In the following, this mechanism that is controlled via a cam switching of the angle lever of the winding mechanism, wherein further the winding crown is used to set the hands and to operate the tourbillon.

Figures 6A, 6B:
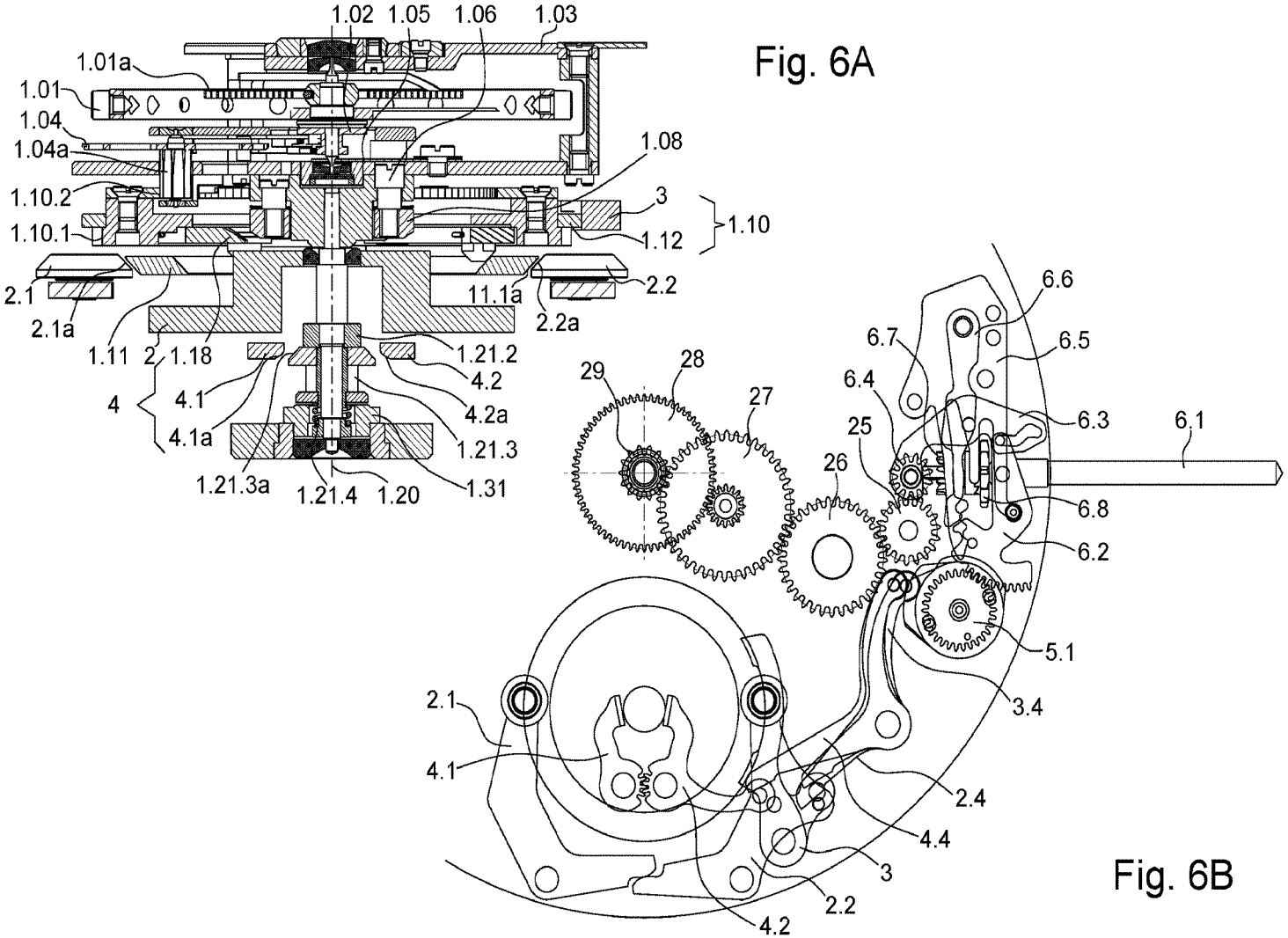

FIGS. 6A & 6B each show two views of the clockwork movement in the base configuration, where the main spring barrel 9 of the timepiece is wound up using the winding crown. This corresponds to the first axial position of the winding crown.

It should be noted that FIG. 6A actually corresponds to FIG. 4 that has already been described.

In this configuration, the balance stop levers 2.1 and 2.2 are opened against the spring force of spring 2.3 by the displacement at the first cam 5.2. The stop ring 1.11 at the disengageable fixing wheel unit 1.10 is pressed downwards by the opening of the latch 1.18. The brake spring 1.05 is in contact with the mobile carriage 1.03 and the balance 1.01 can move freely.

The coupling levers 4.1 and 4.2 are displaced by the third cam 5.4 via the shift lever 4.4 against the force of spring 4.3. The coupling between the second pinion 1.21.3 and the coupling shoulder 1.21.2 is closed so that the rotational movement of the third wheel 7 by the tourbillon pinion 1.21 into the mobile carriage 1.03 can be transmitted to the balance 1.01. The retaining lever 3 experiences no displacement and holds the disengageable fixing wheel unit 1.10 in place using the force of spring 3.3. The tourbillon can run at the internal toothing of the disengageable fixing wheel unit 1.10 just like any conventional tourbillon. The position of the winding stem decouples the coupling drive 6.7 of the winder of the first hand positioning wheel 6.4 by the positioning lever 6.3 and coupling lever 6.6 and a rotational movement of the winding stem 6.1 effects the winding up of the main spring barrel 9 by the winding pinion 6.8.

FIGS. 7A & 7B each show two views of the clockwork movement, the same as those in FIGS. 6A/6B, but now in the balance stop and hand-setting position, i.e. when the winder crown is in the second axial position.

The winding stem 6.1 is now pulled out by one step from the clockwork movement.

Angle lever 6.2 and coupling lever 6.6 allow the coupling pinion 6.7 to engage with the first setting wheel 6.4. The coupling of the coupling pinion 6.7 to the winder of the mainspring barrel (crown wheel) is interrupted. In the gear train: the third hands setting wheel 26, changeover wheel 27, hours wheel 29 and the offset minutes wheel 28 can be set via the first setting wheel 6.4 that meshes with the second hand-positioning wheel 25 so that the hands mechanism can be set.

The camshaft 5 has been appropriately rotated via the toothing on the angle lever 6.2. The first cam 5.2 for the balance stop now releases the shift lever 2.4. The spring 2.3 presses the two balance stop levers 2.1 and 2.2 together so that the stop ring 1.11 is pressed upwards and so displaces inwards the three latches 1.18. Due to that, the latches 1.18 lift the brake ring 1.08. This in turn presses against the brake spring 1.05 via the bolt 1.06. The brake spring 1.05 presses against the double roller 1.02 at the balance 1.01 and so stops this. The tourbillon is stopped and at the same time held fixed in the zero-setting unit 1.10 by the three latches. The retaining lever 3 and the coupling levers 4.1 and 4.2 remain insofar unchanged.

If the winding stem 6.1 is pressed back into its base position (i.e. the position illustrated in the figures FIGS. 6A/6B), the balance stop levers 2.1 and 2.2 are again opened and the balance 1.01 finally released again so that the tourbillon can again continue to run.

FIGS. 8A & 8B each show two views of the clockwork, the same as those in FIGS. 6A/6B, but now in the setting position for the tourbillon unit 1.10, i.e. when the winding crown is in the third axial position.

Figure 9:
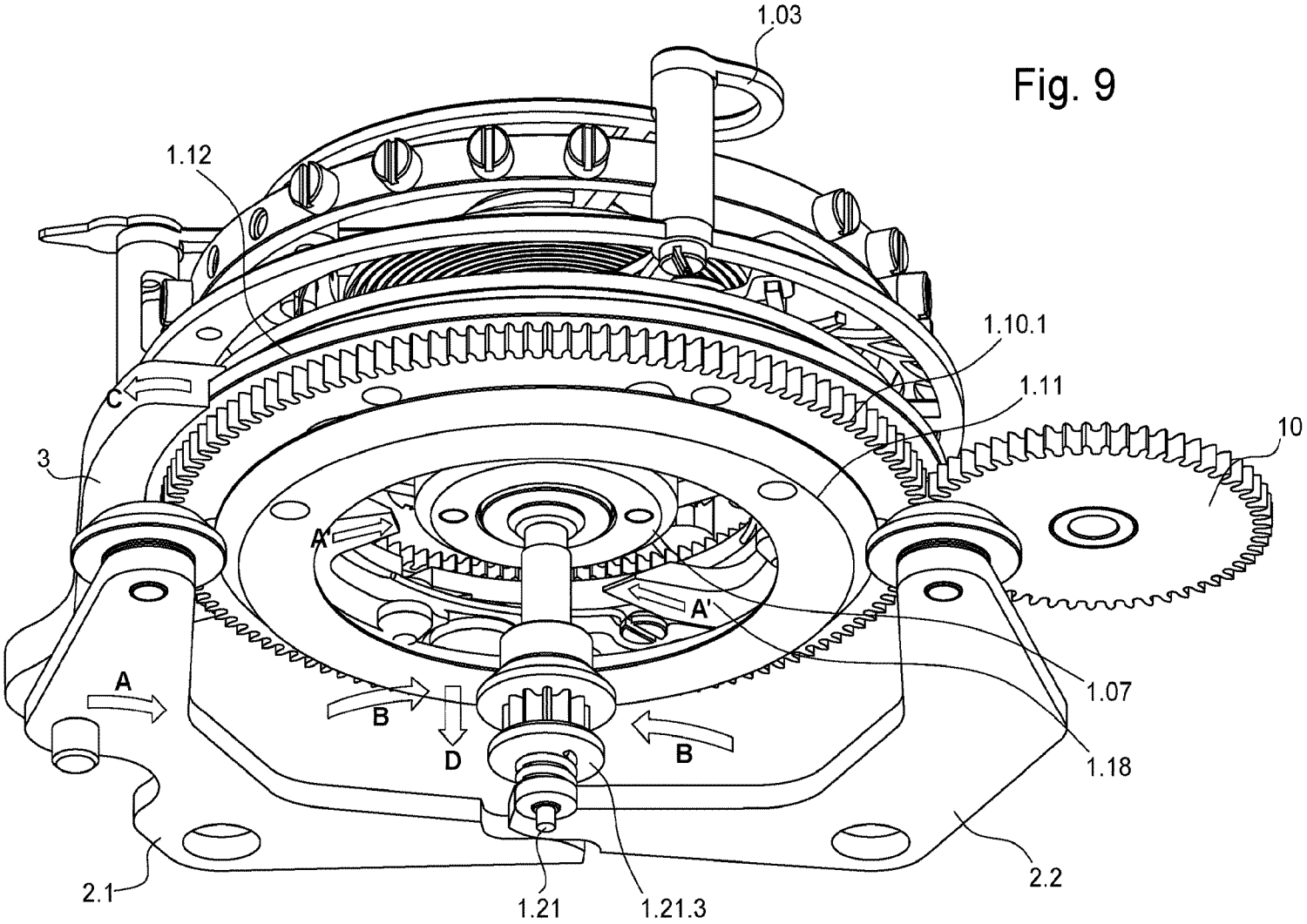

In this position, the winding stem 6.1 is pulled out further to its third position and therefore the setting lever 6.3 moves, guided by the pin of the angle lever 6.2 in the guiding groove of the actuating lever 6.3, the first setting wheel 6.4 away from the second setting wheel 25 to engage with the fourth tourbillon setting wheel 13. During the movement of the angle lever 6.2 to this third axial position, the third cam 5.4 releases the shift lever 4.4 for the coupling levers 4.1 and 4.2. This shift lever 4.4 closes the coupling levers 4.1 and 4.2 by the force of the spring 4.3 against the second pinion 1.21.3 and against the spring 1.21.4 in the direction to the retaining seating 1.31 on the gear train bridge 20. The spring 4.3 provides so much power that the second pinion 1.21 is held fixed by the engaging of the coupling levers 4.1 and 4.2 and at the same time pressed firmly against the retaining seating 1.31. This has to be matched such, that the braking effect produced is securely maintained against the torque of the third wheel 7. Only after the second pinion 1.21.3 is securely positioned on brakes at the tourbillon pinion 1.21, the shift lever 3.4 for the retaining lever 3 is displaced by the second cam 5.3 and opens the retaining lever 3 against the spring 3.3. The disengageable fixing wheel unit 1.10 is now with the whole tourbillon, i.e. especially with the mobile cage 1.03, detached rotatable in the clockwork movement of the gear train. The ratchet point for the third position of the angle lever 6.2 is then finally reached. The third tourbillon setting wheel 13 is non-rotatable connected with the second tourbillon setting wheel 12 and can be rotated by the toothing of the disengageable fixing wheel unit 1.10 and so with the whole tourbillon unit 1 with fixed balance 1.01 for setting in both directions the gear train of the tourbillon setting wheels 1 to 4, i.e. with the reference numbers 13-12-11-10, tourbillon setting wheels shown with the help of the winding stem can be rotated to the desired position FIG. 9 is a view of the tourbillon unit 1 of the clockwork movement of the present invention that emphasizes the inner swivel movement of the balance stop levers 2.1, 2.2, the latches 1.18, the outer swivel movement of the retaining lever 3, and the axial movement of the second pinion 1.21.3 downwards during the placement procedure of the mobile cage. This also provides a summary for the switchover in the various operating modes of clockwork movement, depending on the axial position of the winding stem 6.1 of the winding crown. Namely, the inner swivel movement of the two balance stop levers 2.1 and 2.2 (arrow A) in the changeover of the winding stem from the first axial position to the second position is illustrated. This swivel movement also effects an inner swivel movement of the two latches 1.18 (arrow A'), whereby the balance stop device is activated.

During the changeover from the second axial position to the third axial position of the crown, an inner swivel movement of the coupling levers 4.1 and 4.2 (arrow B) is converted into a downwards axial movement of the seconds drive 1.21.3 (arrow D for the decoupling from the tourbillon drive) as well as an external swivel movement of the retaining lever 3 (arrow C) takes place.

Further alternative possibilities exist in the manner of operation. It is possible to arrange the mechanism so that the tourbillon in the 2. position of the winding stem and the hands position in the 3. position of the winding stem can take place. Combinations with push button operation are also possible.

Figure 10A:
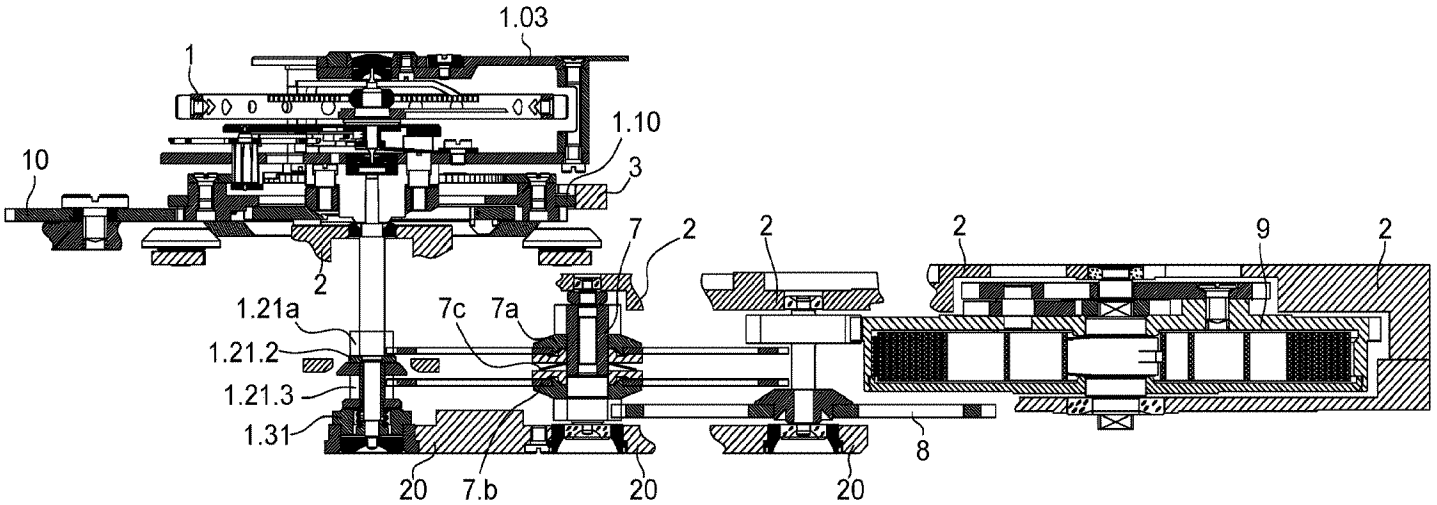
Figure 10B:
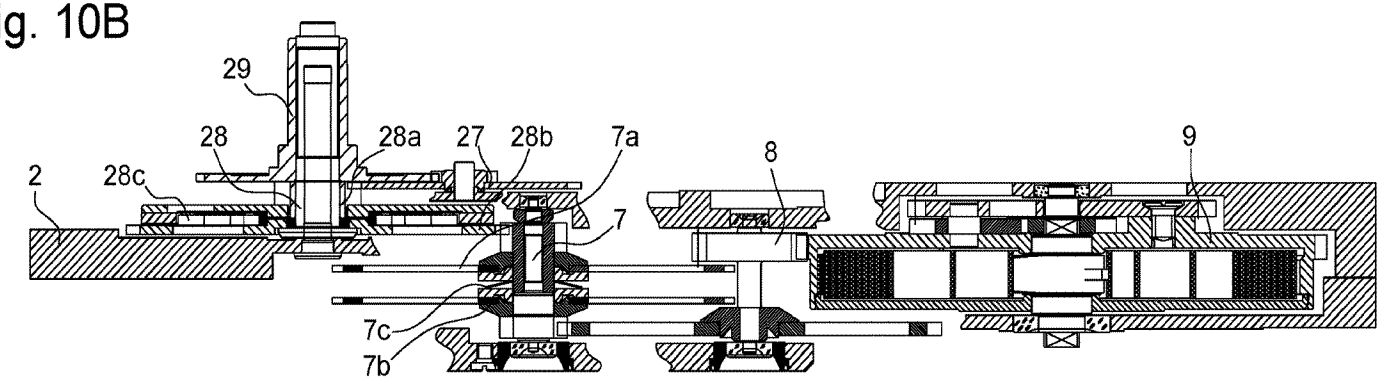

FIGS. 10A and 10B provide as conclusion an illustration of a particularly preferred embodiment for the adjustable tourbillon that further has a coupled minute display. FIG. 10A is a cross-section of the movement between the mainspring barrel and the tourbillon unit whose tourbillon pinion comprises a second torque-proof toothing and FIG. 10B is a cross-section of the movement between the mainspring barrel and the cannon-pinion that comprises the minute ratcheting device in accordance with the same preferred embodiment for an adjustable tourbillon with a minutes ratcheting.

The example shown in FIGS. 1-9 has no coupling with the minute display. During hands setting, the cannon-pinion (29) is simply rotated quite conventionally against a frictional resistance to the minute pinion of the minute wheel 8.

It is however possible to extend this invention with the coupled minutes ratcheting, similar to that of Patent EP2224294 "Mechanism for setting the minutes hand of an automatic zero-setting of the seconds hand". For this, the tourbillon pinion has only to be fitted with a second torque-proof toothing. A fixed transmission ratio of the displayed second of the minutes tourbillon and of the displayed minute are made via a double made toothing on the third wheel which is connected via a friction coupling and minute wheel with the ratchet device as described in Patent EP2224294 of the same applicant.

For this, however, instead of the second pinion for a conventional movement without tourbillon, the tourbillon pinion 1.21 has to be formed in two parts so that it comprises a second fixed toothing 1.21 a that meshes with the third wheel 7*c*. In this description for the adjustable tourbillon, the frictional locking between retaining seating 1.31, coupling drive 1.21 and the coupling levers 4.1 and 4.2 prevents the uncontrolled winding down of the movement during the decoupling of the tourbillon for setting purposes. The structure of a third wheel 7 indicates an upper, settable third wheel 7*a* and a lower third wheel 7*b* located in the power train with the barrel 9 wherein both third wheels are coupled with each other with a friction coupling 7*c*. On the other hand, the minute wheel 28 has a minute ratchet 28*c* instead of a friction coupling between an upper minute wheel 28*a*, that corresponds to the offset minute wheel, and a lower minute wheel 28*b*.

Such an arrangement allows the movement to stop, block, release the tourbillon and to create a released connection out of the fixed tourbillon to the minute wheel 28 movement. If the tourbillon is again coupled into the movement and the movement is running normally, the minute wheel 28 has to be reconnected to the movement; that takes up the friction coupling 7*c* again here in the third wheel 7.

By the interaction of a disengageable fixing wheel unit 1.10 and a coupling in the tourbillon pinion 1.21, also with an existing advantageous balance stop device, it is possible for the first time to control an entire tourbillon unit 1 independently of the escapement in the movement, using an external actuator. That independent movement enables a tourbillon unit 1 to be moved faster and automatically to a reference point in any possible position. This option is especially suitable for a so-called minutes tourbillon, which serves simultaneously as seconds hand.

It is especially advantageous here that no radial forces act on the tourbillon unit 1, neither when the balance 1.01 is stopped nor during the setting procedure. The escapement is namely stopped and therefore protected against external influences during the setting operation. The embodiment shown here of the setting device with the balance stop device also enables a design change to an existing flying tourbillon, as known for example from EP 2 793 087 A1. The tourbillon setting wheels, which are responsible for the setting of the angle device, can also be easily hidden under the mobile cage for aesthetic reasons.

LIST OF REFERENCE NUMBERS

1 Tourbillon unit
- 1.01 Balance
- 1.01*a* Balance spring
- 1.02 Double roller
- 1.03 Mobile cage
- 1.031 Arrow for the seconds hand
- 1.04 Escape wheel
- 1.04*a* Pinion of the escape wheel
- 1.05 Brake spring
- 1.06 Bolt 1
- 1.07 Bolt 2
- 1.08 Brake ring
- 1.08*a* Start slope of the brake ring
- 1.09 Expanding spring
- 1.10 Disengageable fixing wheel unit
- 1.10.1 External toothing of the disengageable fixing wheel unit
- 1.10.2 Internal toothing of the disengageable fixing wheel unit
- 1.11 Stop ring
- 1.11*a* Outer start slope of the stop ring 1.11
- 1.11*b* Inner start slope of the stop ring 1.11
- 1.12 Circumferential band
- 1.14 Circular wheel
- 1.18 Latch
- 1.18*a* Control start slope of the latch 1.18
- 1.18*b* Latch cam

1.19 Latch spring
1.20 Axis of rotation
1.21 Tourbillon pinion
1.21*a* Tourbillon pinion fixed teeth
1.21.1 Arbor
1.21.2 Coupling shoulder
1.21.3 Second pinion
1.21.3*a* Start slope of the second pinion
1.21.4 Coupling spring
1.21.5 Coupling spring support
1.22 Hub
1.31 Retaining seating
2 Base plate
2.1 Balance stop lever 1
2.1*a* Start slope of the balance stop lever 1
2.2 Balance stop lever 2
2.2*a* Start slope of the balance stop lever 2
2.3 Spring for balance stop lever
2.4 Shift lever for balance stop
20 Gear train bridge
3 Retaining lever
3.3 Spring for retaining lever
3.4 Shift lever for retaining lever
4 Coupling device
4.1 First coupling lever
4.1*a* Start slope of the first coupling lever
4.2 Second coupling lever
4.2*a* Start slope of the second coupling lever
4.3 Spring for the coupling levers
4.4 Shift lever for the coupling levers
5 Camshaft
5.1 Toothed wheel on a camshaft
5.2 Cam 1 for balance stop
5.3 Cam 2 for retaining lever
5.4 Cam 3 for coupling of the tourbillon pinion
6 Winding mechanism
6.1 Winding stem
6.2 Angle lever
6.3 Setting lever
6.4 First setting wheel
6.5 Angle lever spring
6.6 Coupling lever 3 (for winding)
6.7 Coupling pinion
6.8 Winding pinion
7 Third wheel
7*a* Upper third wheel
7*b* Lower third wheel
7*c* Friction coupling of the third wheel
8 Minute wheel
9 Main spring barrel
10 First tourbillon setting wheel
11 Second tourbillon setting wheel
12 Third tourbillon setting wheel
13 Fourth tourbillon setting wheel
25 Hands positioning wheel 2
26 Hands positioning wheel 3
27 Changeover wheel
28 Central minute wheel
28*a* Upper minute wheel (minute offset wheel)
28*b* Lower minute wheel
28*c* Detent of minute wheel
29 Hour wheel
(A) Inner swivel movement of both balance stop levers 2.1 & 2.2
(A') Inner swivel movement of both latches 1.18
(B) Inner swivel movement of the coupling levers 4.1 & 4.2
(C) Outer swivel movement of the retaining lever 3
(D) Axial movement of the second pinion 1.21.3 downwards (decoupling)

What is claimed is:

1. A clockwork movement with a tourbillon unit, comprising:
- a base plate,
- a mobile cage mounted rotatably on the base plate and being connected to a second pinion,
- a balance mounted on the mobile cage and an escape wheel mounted on the mobile cage and being in operative connection with the balance,
- a balance stop device being capable to be brought into engagement with the balance,
- a setting device controlled by an external actuating device for any angular orientation of said mobile cage, and
- a disengageable fixing wheel unit that is configured to be brought in a torque-proof engagement with an disengaged from the mobile cage or the base plate, the disengageable fixing wheel unit including a ring-type circumferential wheel with an external toothing that meshes with a first tourbillon setting wheel of the setting device.

2. The clockwork movement according to claim 1, wherein said disengageable fixing wheel unit is torque-proof fixed to the base plate in a base configuration.

3. The clockwork movement according to claim 2, wherein said ring-type circumferential wheel of said disengageable fixing wheel unit includes an internal toothing which meshes with a pinion of the escape wheel.

4. The clockwork movement according to claim 3, wherein said disengageable fixing wheel unit comprises an axially movable stop ring relative to its axis of rotation that corresponds to the axis of rotation of the said tourbillon unit which comprises an outer start slope at a radially outer edge that corresponds to a first or second start slope of a respective first or second balance stop lever that is movably located on the base plate.

5. The clockwork movement according to claim 1, wherein the said balance stop device comprises a movable brake spring located at the mobile cage and being engaged frictionally with the balance axially to a rotating axis that corresponds to the one of the said tourbillon unit.

6. The clockwork movement according to claim 1, wherein the tourbillon unit also comprises a coupling device between a torque-proof tourbillon pinion connected to the said mobile cage and the said second pinion, that lies in a power train path from a mainspring barrel.

7. The clockwork movement according to claim 6, wherein said coupling device provides swivelable coupling levers, which effect an axial shift of the said second pinion against a retaining seating, and comprises a coupling spring which exerts a restoring force for said second pinion along the rotational axis of the tourbillon unit.

8. The clockwork movement according to claim 1, wherein the external actuating device is a winding crown which can have three different axial positions, wherein a first axial position of the three different axial positions corresponds to a basic configuration in which a rotational movement of the winding crown effects a winding up of a mainspring barrel, wherein in a second axial position of the three different axial positions of said winding crown the balance stop device is activated and effects a rotational movement of said winding crown, and wherein a third axial position of the three different axial positions of said winding crown causes a rotational movement of said winding crown that effects a setting of the angular orientation of said movable cage.

9. The clockwork movement according to claim 8, wherein in the third axial position of the winding crown the disengageable fixing wheel unit is released from the base plate and torque-proof engaged with the mobile cage as well as a coupling device between said mobile cage torque-proof connected to a tourbillon pinion and said second pinion is activated that lies in a power transmission path with the mainspring barrel.

10. The clockwork movement according to claim 9, wherein at least one balance stop lever is provided for the activation of said balance stop device, wherein a retaining lever for the retaining of said disengageable fixing wheel unit against the base plate is provided and wherein at least one coupling lever for the decoupling between the tourbillon drive and said second chive is provided.

11. The clockwork movement according to claim 10, wherein respective rest and working positions of said balance stop levers, of said retaining lever, and of said coupling levers are controlled by a camshaft.

12. The clockwork movement according to claim 11, wherein said camshaft has three cams one above the other, each working to a dedicated switching plan, including the first cam for the control of the balance stop lever, a second cam for the control of the retaining lever, and a third cam for the control of the coupling levers.

13. The clockwork movement according to claim 12, wherein the said camshaft further comprises a superposed gear wheel that is coupled to the angle lever by one of the said actuators.

14. The clockwork movement according to claim 1, wherein the clockwork movement is also coupled to a minutes hand, and wherein a second fixed toothing is located on a tourbillon pinion.

15. A timepiece comprising the movement according to claim 1.

16. A clockwork movement with a tourbillon unit, comprising:

a base plate, a mobile cage mounted rotatably on the base plate and being connected to a second pinion, a balance mounted on the mobile cage and an escape wheel mounted on the mobile cage and being in operative connection with the balance, a balance stop device being capable to be brought into engagement with the balance, a setting device controlled by an external actuating device for any angular orientation of said mobile cage, wherein the external actuating device is a winding crown that includes a first axial position, a second axial position, and a third axial position, wherein the first axial position corresponds to a basic configuration, in which a rotational movement of the winding crown effects a winding up of a mainspring barrel, wherein in the second axial position of said winding crown the balance stop device is activated and effects a rotational movement of said winding crown, and wherein the third axial position of said winding crown causes a rotational movement of said winding crown that effects a setting of the angular orientation of said movable cage.

17. The clockwork movement according to claim 16, wherein in the third axial position of the winding crown a disengageable fixing wheel unit is released from the base plate and torque-proof engaged with the mobile cage as well as a coupling device between said mobile cage torque-proof connected to a tourbillon pinion and said second pinion is activated that lies in a power transmission path with the mainspring barrel.

18. The clockwork movement according to claim 17, wherein at least one balance stop lever is provided for the activation of said balance stop device, wherein a retaining lever for the retaining of said disengageable fixing wheel unit against the base plate is provided and wherein at least one coupling lever for the decoupling between the tourbillon drive and said second drive is provided.

19. The clockwork movement according to claim 18, wherein respective rest and working positions of said balance stop levers, of said retaining lever, and of said coupling levers are controlled by a camshaft.

20. The clockwork movement according to claim 19, wherein said camshaft has three cams one above the other, each working to a dedicated switching plan, including the first cam for the control of the balance stop lever, a second cam for the control of the retaining lever, and a third cam for the control of the coupling levers.

* * * * *